US006193095B1

(12) United States Patent
McNeil

(10) Patent No.: US 6,193,095 B1
(45) Date of Patent: Feb. 27, 2001

(54) BAG DISPENSER

(76) Inventor: Don McNeil, 6120 Farnswood Apt. 1303, Fort Worth, TX (US) 76112

( * ) Notice: Subject to any disclaimer, the term of this patent is extended or adjusted under 35 U.S.C. 154(b) by 0 days.

(21) Appl. No.: 09/222,552

(22) Filed: Dec. 29, 1998

(51) Int. Cl.[7] ..... B65D 25/00
(52) U.S. Cl. ..... 220/495.07; 220/908.1
(58) Field of Search ..... 220/495.07, 495.11, 220/495.06, 908.1

(56) References Cited

U.S. PATENT DOCUMENTS 3,451,453 * 6/1969 Heck ..... 220/495.07 X
4,349,123 * 9/1982 Yang ..... 220/495.07
5,000,340 * 3/1991 Leggio ..... 220/495.07
5,322,180 * 6/1994 Ker ..... 220/495.07
5,405,041 * 4/1995 VanBrackle ..... 220/495.07
5,503,292 * 4/1996 Cuccharia ..... 220/495.07
5,671,847 * 9/1997 Pedersen et al. ..... 220/495.07 X
5,730,312 * 3/1998 Hung ..... 220/495.07 X

* cited by examiner

*Primary Examiner*—Steven Pollard
(74) *Attorney, Agent, or Firm*—W. Thomas Timmons

(57) ABSTRACT

A dispenser from which flexible liner bags within a refuse receptacle can be dispensed seriatim and is comprised of an anchor adapted for secured mounting onto the floor of the receptacle with which the dispenser is to be utilized and an elongated housing for removable attachment to the anchor and defining an open cavity into which a supply of conventional pre-wound liner bags in a roll format can be received and dispensed.

10 Claims, 3 Drawing Sheets

BAG DISPENSER

FIELD OF THE INVENTION

The field of art to which the invention relates comprises the art of refuse disposal and liner bags internally dispensed from within the receptacle therefor.

1. Background of the Invention

The use of various receptacles for lightweight refuse disposal from the wastebasket to the portable trash bin are common-place and are widely provided on site. In domestic situations, most every room in the house includes at least-one refuse receptacle that may vary in size and shape depending as a matter of choice, on anticipated needs.

In recent years, many municipalities have begun requiring that refuse when ultimately discarded for pickup or dumping to be placed within a plastic liner bag for disposal. While commercially available and conveniently packaged in wound-up roll form when purchased, the liner bags are frequently regarded as an annoyance to install individually within the receptacle prior to placement of refuse therein. When filled, the bags are removed and discarded to a convenient site.

2. Background of the Prior Art

To minimize handling during individual installation of liner bags, various devices in the prior art have been developed that will accommodate the pre-wound roll package internally within the refuse receptacle so as to enable dispensing the liner bags seriatim one at a time. By means thereof, liner bags can be drawn directly from within the receptacle and installed in and about the receptacle as required. As the filled bag is withdrawn for disposal, the next bag, still attached is simultaneously withdrawn therewith. Exemplifying such prior art is the disclosure of U.S. Pat. No. 4,364,490.

While such dispenser devices of the prior art have undoubtedly functioned well, they are generally characterized as requiring specially designed receptacles in order to internally accommodate and dispense the package of pre-wound liner bags. As a consequence, such standard rolls cannot be accommodated in conventional unmodified receptacles without major modification and are therefore unsuitable for use as a retrofit installation for the receptacle after-market.

Despite recognition of the foregoing limitations, a ready solution therefore has not heretofore been known.

OBJECTS OF THE INVENTION

It is therefore an object of the invention to provide a novel structure for mounting a package of pre-wound liner bags for dispensing internally of a refuse receptacle.

It is a further object of the invention to effect the previous object with a structure conveniently adapted for installation as a retrofit in a pre-existing receptacle.

It is a still further object of the invention to effect the previous objects in a highly convenient, economical and expeditious manner.

SUMMARY OF THE INVENTION

This invention relates to apparatus for dispensing of pre-wound rolls of individual liner bags from within a refuse receptacle. More specifically, the invention relates to a bag dispenser apparatus installable within refuse receptacles that is greatly simplified as compared to previous installations therefor. At the same time, the apparatus is conveniently suitable, not only for fabrication by original receptacle manufacturers, but also on a retrofit basis.

To achieve the foregoing, there is provided a dispenser for receptacle installation comprising, an elongated removable holder or housing in which to receive and accommodate a packaged pre-wound roll of liner bags. The housing of plastic composition includes an elongated slot at its top surface for permitting one at a time withdrawal of liner bags from the roll. Installation within and about the receptacle includes a variety of anchor constructions at the standard floor of the receptacle enabling the housing to be removably secured thereat.

One anchor support embodiment includes an elongated channel-like support plate secured internally to the floor of the receptacle and having elongated oppositely parallel, inwardly turned side channels. The underside of the housing includes elongated turned out flanges oppositely parallel and suitable for a snap-in interfit within the side channels of the support. For replacing a pre-wound roll of liner bags, the housing flanges can be hand squeezed toward each other enabling the housing to be removed from the side channels. With a fresh roll in place, the flanges are similarly squeezed and then released for expansion outward to within the side channels.

A second anchor support embodiment includes a plurality of spaced apart hooks on both sides of the housing and a plurality of hooks secured in the floor of the receptacle. Hooks at corresponding locations are joined together by a removable elastic cord that when connected between paired hooks secure the housing in place. Freeing one or both ends of each cord enables the housing to be removed for receipt of a bag roll and then replaced.

For retrofit installation, either of the above embodiments can be conveniently added by merely securing the support channel and/or hooks to the receptacle floor as above.

The above noted features and advantages of the invention as well as other superior aspects thereof will be further appreciated by those skilled in the art upon reading the detailed description that follows in conjunction with the drawings.

DESCRIPTION OF THE PREFERRED EMBODIMENT

Figure 1:
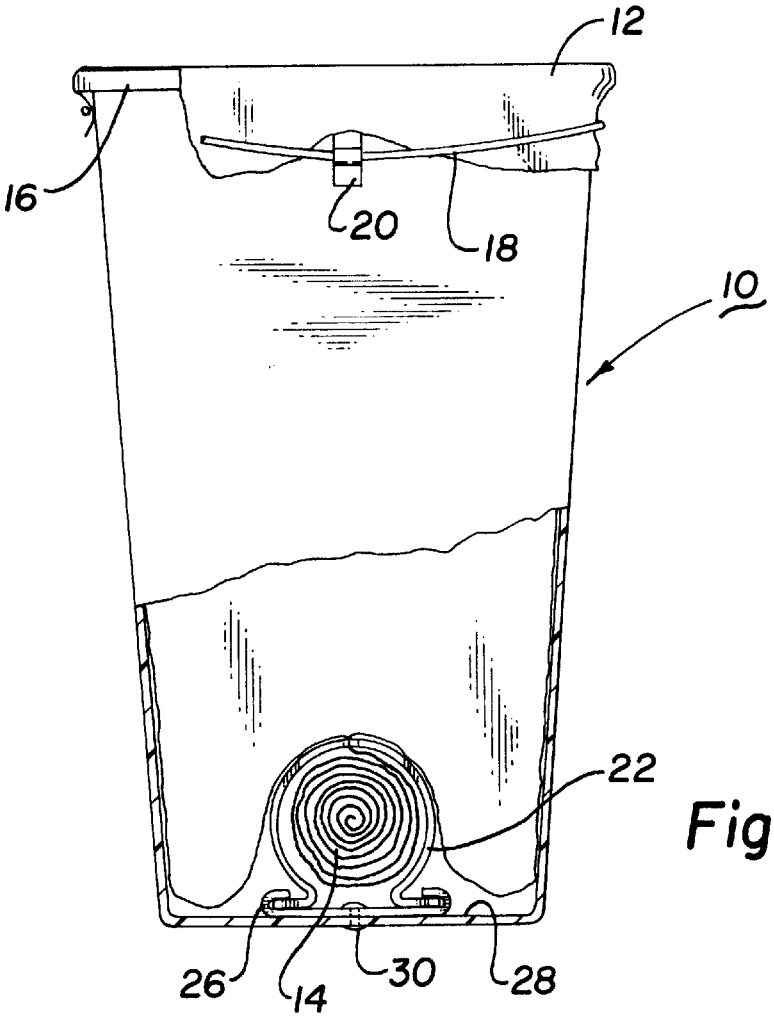
FIG. 1 is a side elevation partially sectioned of a refuse receptacle containing a pre-wound roll of liner bags in the manner hereof.
Figure 3:
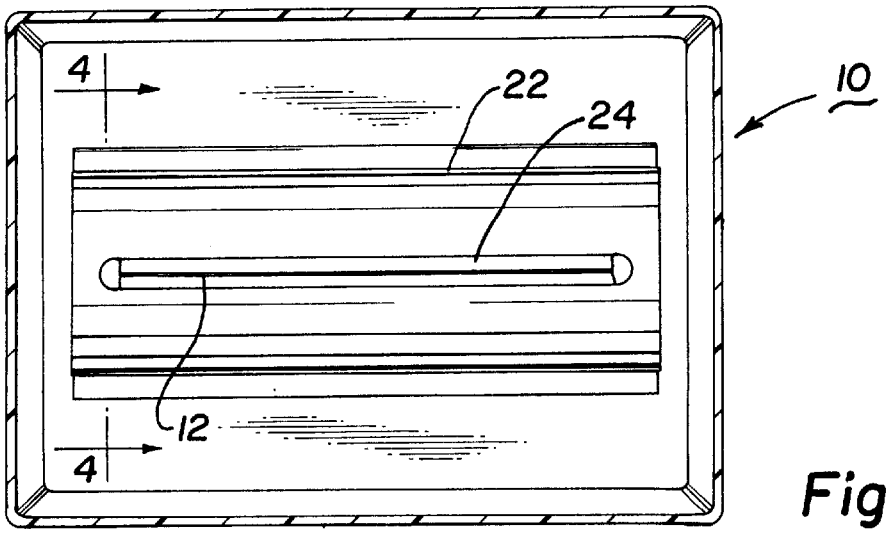
FIG. 3 is a sectional view as seen substantially along the lines 3—3 of FIG. 2.

In the description which follows, like parts are marked throughout the specification and drawings with the same reference numerals respectively. The drawing figures are not necessarily to scale and in certain views, parts may have been exaggerated for purposes of clarity.

Referring now to the drawings, there is illustrated in FIG. 1 a typical upright basket type refuse receptacle designated 10 from which a liner bag 12 has been dispensed from a roll of bags 14 to extend up and over a peripheral flange 16. In the installation shown, the upper end of bag 12 is folded over flange 16 and secured in place by an encircling elastic cord 18 that in turn is secured in place by a bracket 20.

Roll 14 represents a commercially available pre-wound roll of serially attached liner bags retained in place for manually induced rotation within a holder housing 22. The holder housing, of plastic composition, is generally circular in section and of an internal diameter larger than the contained liner roll. An elongated slot 24 along the top permits a bag 12 to be withdrawn outward for dispensing as needed. For installation in order to removably secure the housing in place, there is provided a variety of different anchor structures for receiving and securing the housing on floor 28 of the receptacle as will be described.

As illustrated in FIGS. 1–5, there is shown a first anchor embodiment including an elongated channel-like anchor support 26 secured to floor 28 of receptacle 10 by means of spaced apart rivets 30. Opposite parallel edges 32 and 34 of support 26 define reverse bent arms defining internal spacings 36 in which to receive opposite turned-out housing flanges 38 and 40 in an interfit relation.

Figure 4:
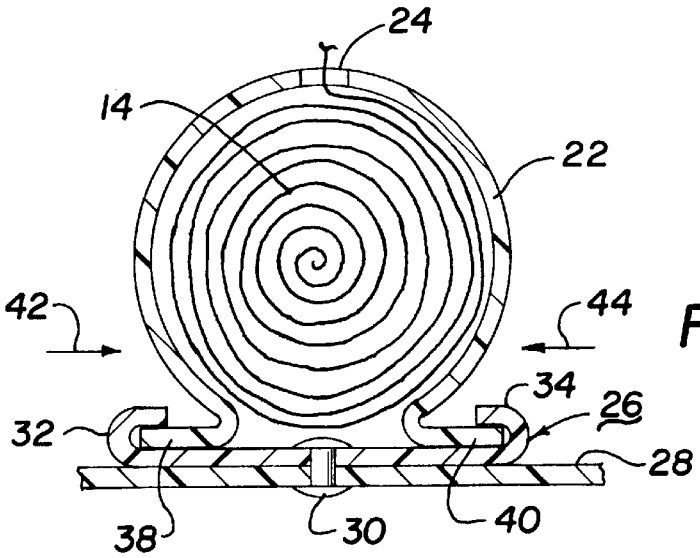
FIG. 4 is an enlarged sectional view of the bag housing of FIG. 1 as seen substantially along the lines 4—4 of FIG. 3.
Figure 5:
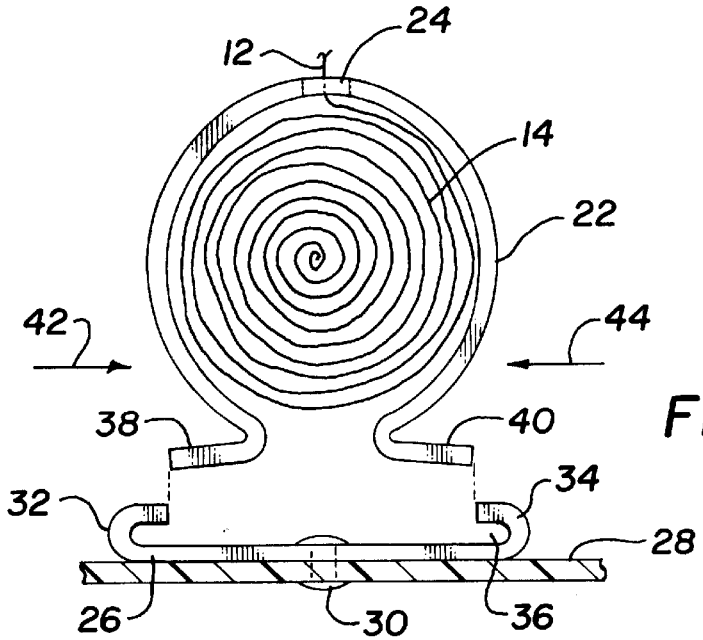
FIG. 5 is a view similar to FIG. 4 illustrating the separation relation of the bag housing to the housing support.

To install housing 22 to anchor 26 as shown in the assembly of FIG. 4, opposite side surfaces of the holder are squeezed manually at about the location of arrows 42 and 44 then moved downward t o be released to within arm spacings 36. Removal requires only that the housing be similarly squeezed and then raised above channel arms 32 and 34 before being released. With the housing removed, a fresh roll of bags can be installed from either end.

Figure 6:
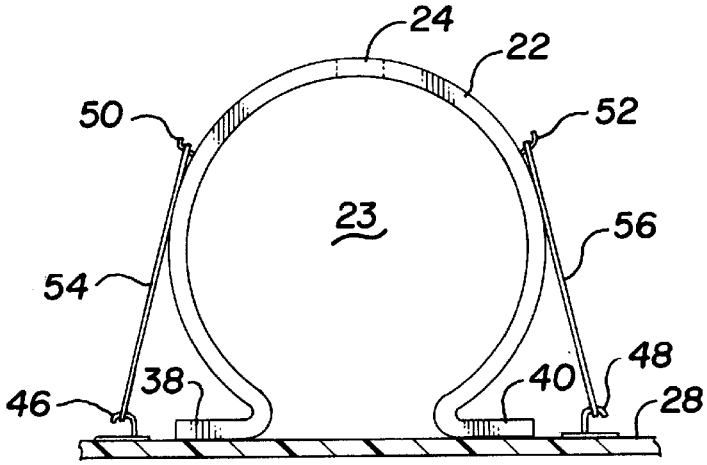
FIG. 6 is a second embodiment of the housing support in the manner hereof.

For the second embodiment of FIG. 6, the flanges 38 and 40 of housing 22 seat directly against the surface of receptacle floor 28 rather than using a support channel as above. This embodiment utilizes for anchoring a plurality of longitudinally spaced apart hooks 46 and 48 oppositely embedded and secured in receptacle floor 28. Companion hooks 50 and 52 at longitudinal locations in the periphery of housing 22 corresponding to locations of hooks 46 and 48, cooperate with hooks 46 and 48 to secure tensioned elastic cords 54 and 56. This serves to retain and seat foot flanges 38 and 40 against floor 28. In this embodiment, housing 22 can be readily removed by manually releasing cords 54 and 56 from their hooks at one or both ends. With the housing unsecured, it can be raised within the receptacle and removed for installation of a fresh wound roll 14 of liner bags 12.

Installation for either of the above embodiments requires only that an anchor be secured to a receptacle floor that enables the housing to be installed or removed with a minimum of inconvenience. With the housing removed, a pre-packaged roll liner of bags 14 can be readily inserted longitudinally within the housing from either end with a lead bag 12 extending through aperture slot 24. The housing can be readily inserted or connected to the anchor where it is retained securely until removed for installing a fresh supply of liner roll 14 after the previous supply roll has been exhausted.

Figure 2:
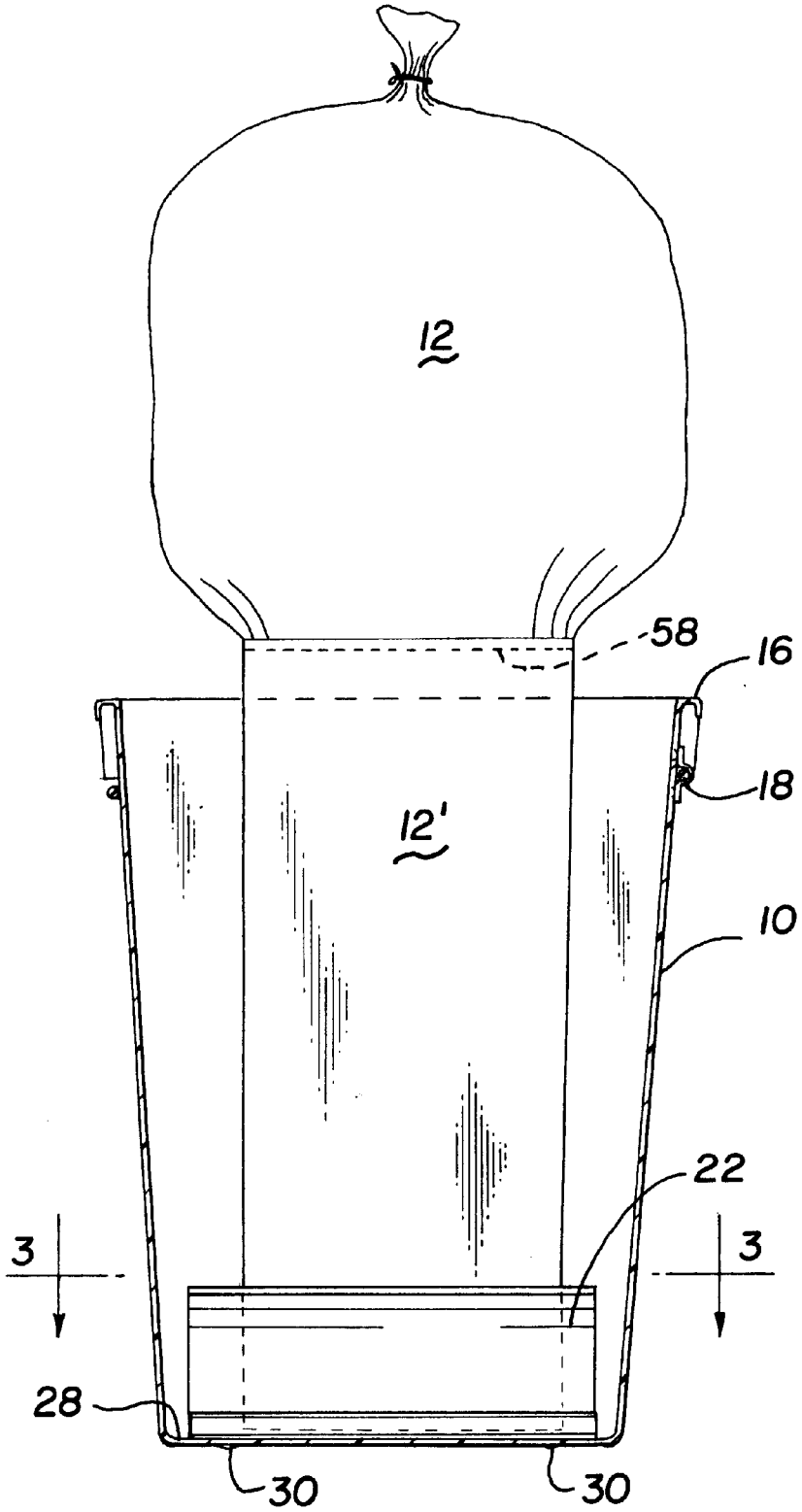
FIG. 2 is a sectional elevation illustrating simultaneous removal and dispensing of a liner bag in accordance herewith.

In use, lead bag 12 from roll 14 is dispensed by being drawn up through slot 24 and folded over receptacle flange 16 and secured by elastic cord 18 (FIG. 1). Once the lead bag has filled with debris, refuse or trash, it is drawn upwardly as seen in FIG. 2 until outward of the receptacle. Simultaneously, subsequent bag 12' is drawn upward and can conveniently be separated from filled bag 12 by tearing along seam line 58. Bag 12' is then installed in the manner that previous bag 12 had been installed. Repeated replacements, such as that just described, can continue until the entire supply roll 14 has been exhausted. At that point, housing 22 is withdrawn from its anchor and a fresh roll of bags replaced longitudinally within and the housing which is then re-secured to its anchor as above.

By the above description there is disclosed a novel bag dispenser for a trash receptacle that overcomes many of the deficiencies of the prior art devices previously proposed for these purposes. Unlike the prior art devices that require special receptacle construction for special support, etc. and which potentially limit the market for such devices, the apparatus hereof is adapted for virtually universal installation either as original equipment or after-market situation. Because of its versatility, it can be readily purchased off the shelf apart from the receptacle for those wanting to adapt its use as a retrofit on existing receptacles. At the same time, its construction is relatively simple such that costs therefor are modest at best enabling it to be readily affordable in mass markets.

Since many changes could be made in the above construction and many apparently widely different embodiments of this invention could be made without departing from the scope thereof, it is intended that all matter contained in the drawings and specification shall be interpreted as illustrative and not in a limiting sense.

I claim:

1. A dispenser from which flexible liner bags can be dispensed seriatim within a refuse receptacle, comprising:

an anchor comprising elongated oppositely parallel, inwardly turned side channels adapted for installation onto the floor of a receptacle in which the dispenser is to be utilized;

an elongated housing defining an internal cavity into which a supply roll of continuous liner bags can be received, said housing including a slot through which liner bags from said roll can be withdrawn seriatim and parts on said housing adapted to operatively cooperate with said anchor for removably mounting said housing to said anchor, said parts comprise opposite flanges extending outwardly from the underside of said housing that are transversely squeezable toward each other for insertion and removal of the housing to and from said anchor.

2. A dispenser according to claim 1 wherein the elongated housing is at least partially open at the ends to facilitate squeezing the opposite flanges toward each other.

3. A dispenser from which flexible liner bags can be dispensed seriatim, comprising:

an anchor comprising elongated oppositely parallel inwardly turned side channels adapted for installation onto a surface on which the dispenser is to be utilized;

an elongated housing defining an internal cavity into which a supply roll of continuous liner bags can be received, said housing including a slot through which liner bags from said roll can be withdrawn seriatim and parts on said housing adapted to operatively cooperate with said anchor for removably mounting said housing to said anchor, said parts comprise opposite flanges extending outwardly from the underside of said housing that are transversely squeezable toward each other for insertion and removal of the housing to and from said anchor.

4. A dispenser according to claim 3 wherein the elongated housing is at least partially open at the ends to facilitate squeezing the opposite flanges toward each other.

5. A dispenser from which flexible liner bags can be dispensed seriatim within a refuse receptacle, comprising:

an anchor adapted for installation onto the floor of a receptacle in which the dispenser is to be utilized;

an elongated housing defining an internal cavity into which a supply roll of continuous liner bags can be received said housing including a slot through which liner bags from said roll can be withdrawn seriatim and parts on said housing adapted to operatively cooperate with said anchor for removably mounting said housing to said anchor in which said anchor comprises a plurality of longitudinally spaced first hooks secured to the floor of said receptacle, there is included a plurality of second hooks secured in the periphery of said housing at longitudinal locations corresponding substantially to the longitudinal locations of said first hooks and tie means connecting said first and second hooks in a tension relation for preventing self-displacement of said housing.

6. A dispenser in accordance with claim 5 in which said parts operatively cooperate with said anchor in a toolless installation.

7. A dispenser in accordance with claim 6 in which said internal cavity is defined at least partially by an arcuate housing wall of internal diameter larger than the diameter of a bag roll to be received.

8. A dispenser in accordance with claim 5 in which said tie means comprises an elastic member for effecting a tension draw between said first and second hooks for retaining said housing contiguously seated on said receptacle floor.

9. A dispenser from which flexible liner bags can be dispensed seriatim, comprising:

an anchor adapted for installation onto a surface;

an elongated housing defining an internal cavity into which a supply roll of continuous liner bags can be received, said housing including a slot through which liner bags from said roll can be withdrawn seriatim and parts on said housing adapted to operatively cooperate with said anchor for removably mounting said housing to said anchor in which said anchor comprises a plurality of longitudinally spaced first hooks secured to the surface, there is included a plurality of second hooks secured in the periphery of said housing at longitudinal locations corresponding substantially to the longitudinal locations of said first hooks and tic means connecting said first and second hooks in a tension relation for preventing self-displacement of said housing.

10. A dispenser in accordance with claim 9 in which said tie means comprises an elastic member for effecting a tension draw between said first and second hooks for retaining said housing contiguously seated on said surface.

* * * * *